United States Patent [19]

Smith et al.

[11] 3,998,406

[45] Dec. 21, 1976

[54] GUIDED MISSILE SYSTEM

[75] Inventors: Carl H. Smith, Newport Beach; Louis G. Walters; Eric Durand, both of Santa Ana, all of Calif.

[73] Assignee: Aeronutronic Ford Corporation, Blue Bell, Pa.

[22] Filed: May 28, 1964

[21] Appl. No.: 371,048

[52] U.S. Cl. ..... 244/3.14; 244/3.11; 244/3.16

[51] Int. Cl.[2] ..... F41G 7/00; F42B 15/02; G06F 15/50

[58] Field of Search ..... 244/14, 14.1, 14.2, 244/14.4, 14.5, 14 A–14 D, 3.1, 3.11–3.14, 3.15, 3.16

[56] References Cited

UNITED STATES PATENTS

| | | | |
|---|---|---|---|
| 2,404,942 | 7/1946 | Bedford | 244/14 |
| 2,944,763 | 7/1950 | Grandgent et al. | 244/14 |
| 2,981,500 | 4/1961 | Carlton | 244/14 |
| 3,168,264 | 2/1965 | Sendles | 244/14 D |

*Primary Examiner*—Malcolm F. Hubler
*Attorney, Agent, or Firm*—Robert D. Sanborn

EXEMPLARY CLAIM

1. A missile guidance system for continuously guiding a missile along a line of sight between a vehicle and a target comprising, tracker means which is located solely on said vehicle, includes a radiation-sensitive element, and is responsive to the impingement of radiant energy on said element to generate signals indicative of the direction of impingement of said radiant energy on said element, relative to the orientation of said element, a source of radiant energy, positioned on said missile, means, located solely on said vehicle and operable by a human operator, for locating said element of said tracker means in an orientation and position which bears a fixed spatial relationship to said line of sight, said tracker means, when said element is so oriented and positioned and impinged by radiant energy from said source, being adapted to generate yaw signals indictive of the deviation in azimuth of said source with respect to said line of sight and being also adapted to generate pitch signals indicative of the deviation in elevation of said source with respect to said line of sight, said source and said tracker means comprising a first communications link between said missile and said vehicle, a guidance and control computer in said vehicle having a yaw channel responsive to said vehicle tracker yaw signals and having a pitch channel responsive to said vehicle tracker pitch signals, each of said yaw and pitch channels having an equalizer network responsive to the respective yaw and pitch signals from said vehicle tracker to equalize said yaw and pitch signals, each of said yaw and pitch channels having means for limiting said equalized signal in each said channel, a computer programmer for generating a gain compensating signal proportional to the missile flight time, and a line of sight compensating signal proportional to target motion at right angles, each of said yaw and pitch channels having a summation circuit for adding said limited equalized signals, said gain compensating signal, and said line of sight compensating signal to provide yaw and pitch command signals, a second communication link between said missile and said vehicle including a transmitter in said vehicle for transmitting said yaw and pitch command signals, and a receiver in said missile for receiving said command signals, and flight control means in said missile for guiding said missile in response to said command signals received by said receiver.

6 Claims, 6 Drawing Figures

Figure 1:
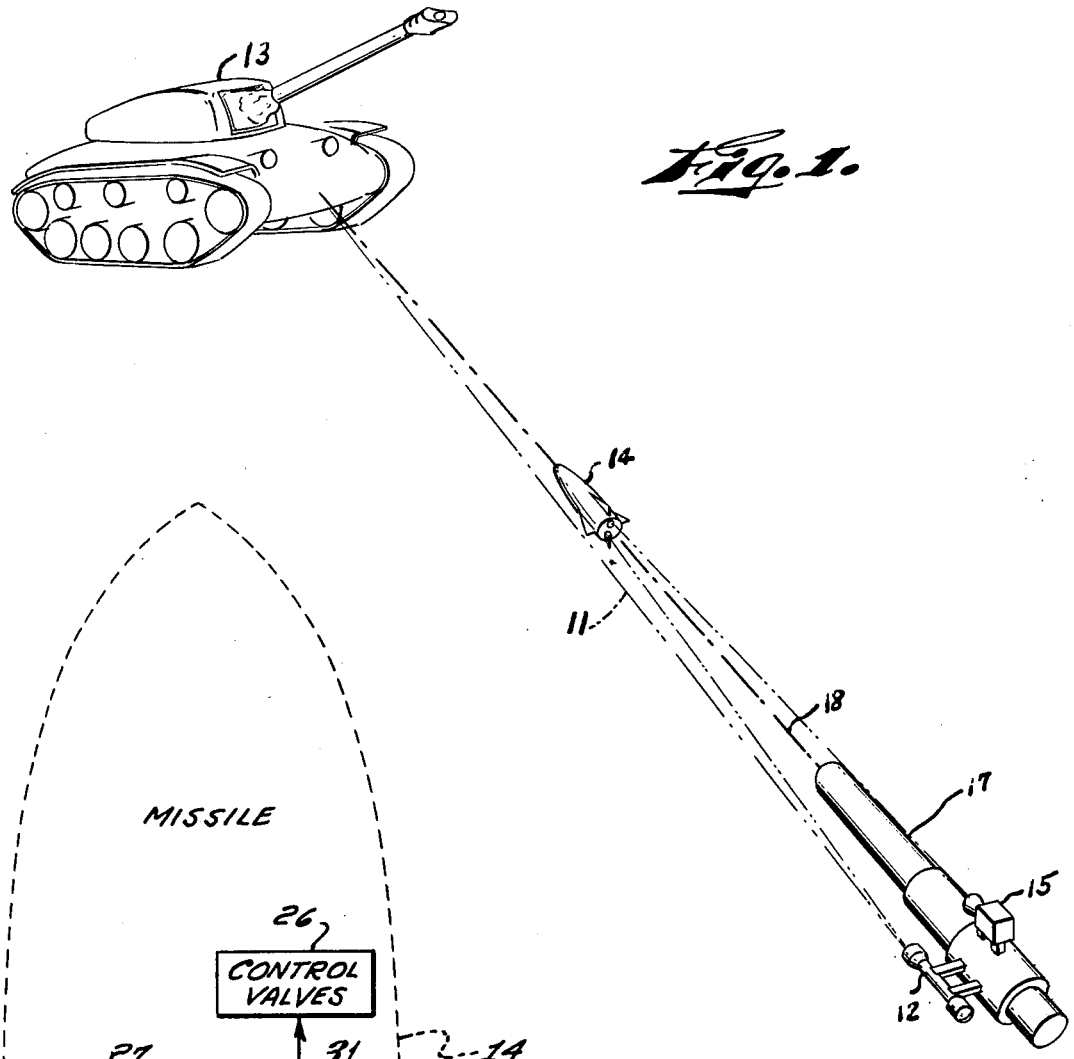

INVENTORS
CARL H. SMITH
LOUIS G. WALTERS
BY ERIC DURAND
By Robert D. Lanham
ATTORNEY INVENTORS
CARL H. SMITH
LOUIS G. WALTERS
ERIC DURAND
BY
By Robert D. Sanborn
ATTORNEY INVENTORS
CARL H. SMITH
LOUIS G. WALTERS
BY ERIC DURAND
By Robert D. Sanborn
ATTORNEY

GUIDED MISSILE SYSTEM

This invention relates to missile guidance systems and more particularly to a guidance and control system for guiding a missile from a vehicle to a ground target.

A basic function of a missile and control system is to constrain the missile to fly along a straight line between a launching vehicle and a target. In order to perform this function the guidance and control system determines the deviation of the missile from a line of sight to the target, transmits command information to the missile based on the measured missile deviation from the line of sight and commands missile control forces according to the transmitted command signals to reduce the missile deviation from the line of sight.

The advent of weapons systems which fire a missile from a ground vehicle to a ground target has created the need for a guidance and control system compatible with the special environment existing near the ground. Such a system must be capable of providing reliable and accurate and continuous guidance and control during the entire flight of the missile. Special problems not heretofore presented are incurred with a missile operating near the ground level. For example, atmospheric shimmer and other disturbances near the ground may seriously interfere with the guidance and tracking link between the vehicle and the missile.

Prior art weapons guidance systems are designed to operate in the air or in space with little interference from the atmosphere. Such systems are not designed for short range operation near the ground and are unable to overcome the special problems created by ground operation. Accordingly, it is an object of this invention to provide a guidance control system for guiding a missile from a vehicle to a ground target.

The guidance and control system of this invention utilizes infrared tracking and controlling links for continuously tracking and controlling a missile fired from a ground vehicle to a ground target. The missile is maintained on a target line of sight by a simple, reliable, and accurate system. The system will operate within severe environment conditions caused by the operation of the missile near the ground level.

It is therefore another object of this invention to provide a system for guiding a missile from a vehicle to a ground target with the missile operating near the ground level.

It is another object of this invention to provide a guidance and control system for a missile fired from a vehicle to a ground target utilizing infrared tracker command means.

It is a further object of this invention to provide a system for tracking and guiding a missile from a vehicle to a ground target utilizing equalization and compensating networks for stabilizing the missile along the line of sight to the target.

Figure 2:
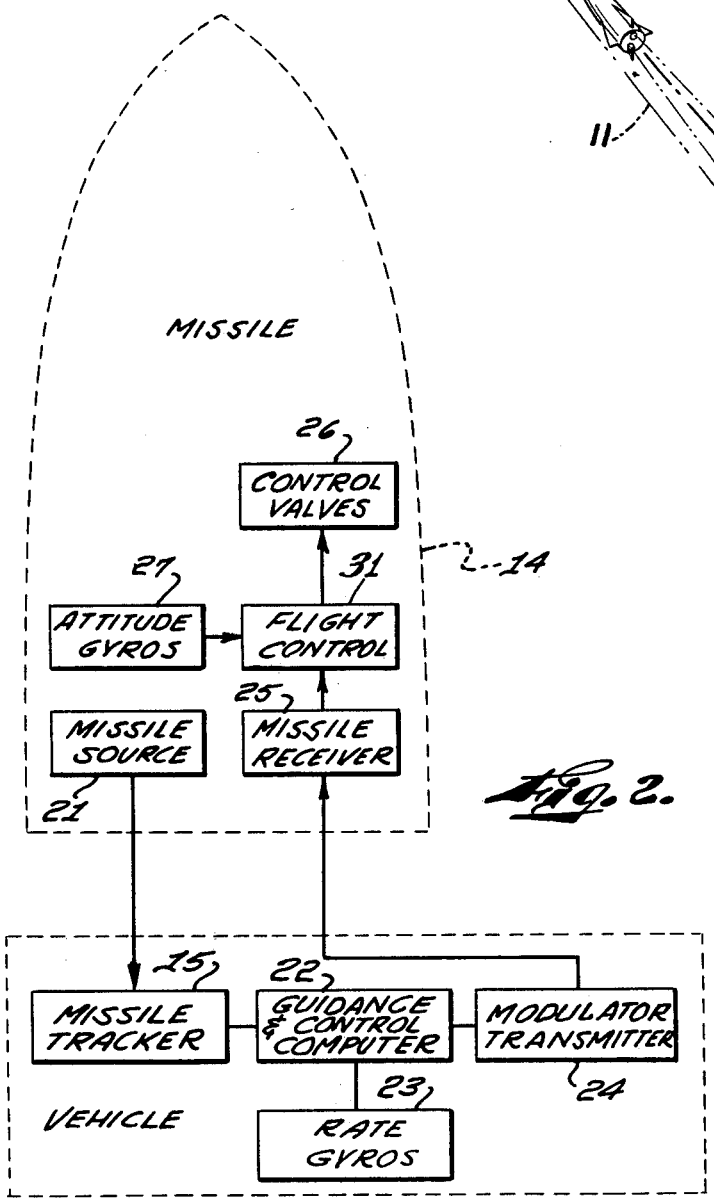
Figure 3:
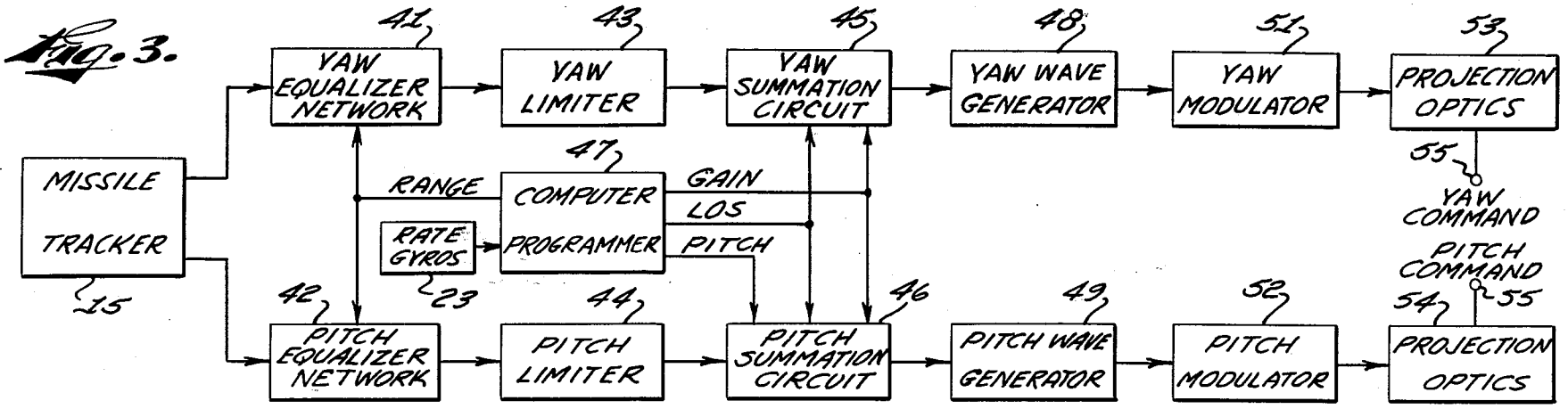
Figure 4:
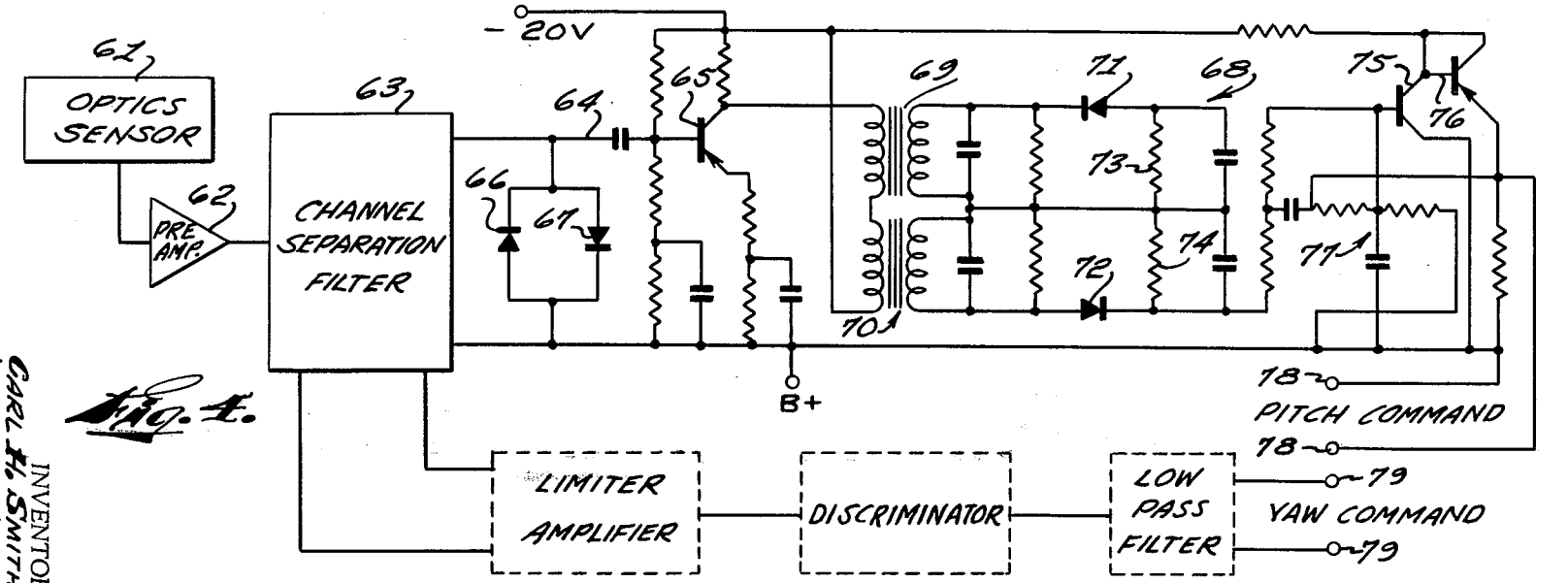
Figure 5:
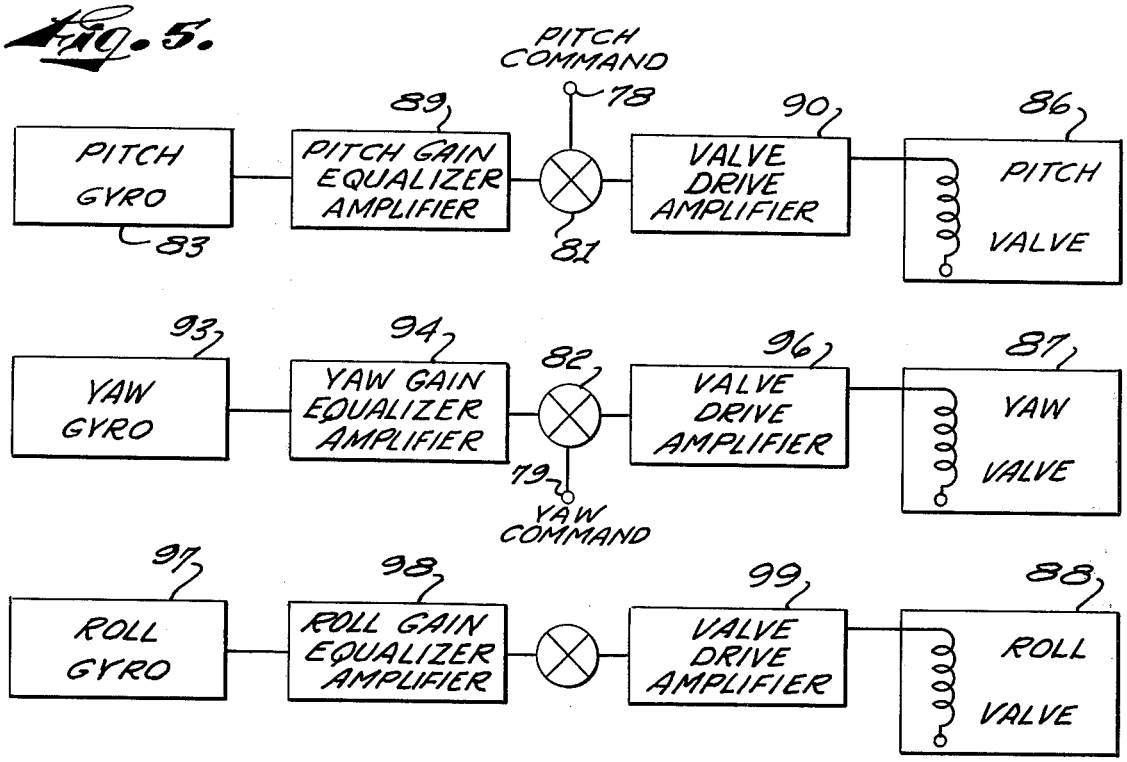
Figure 6:
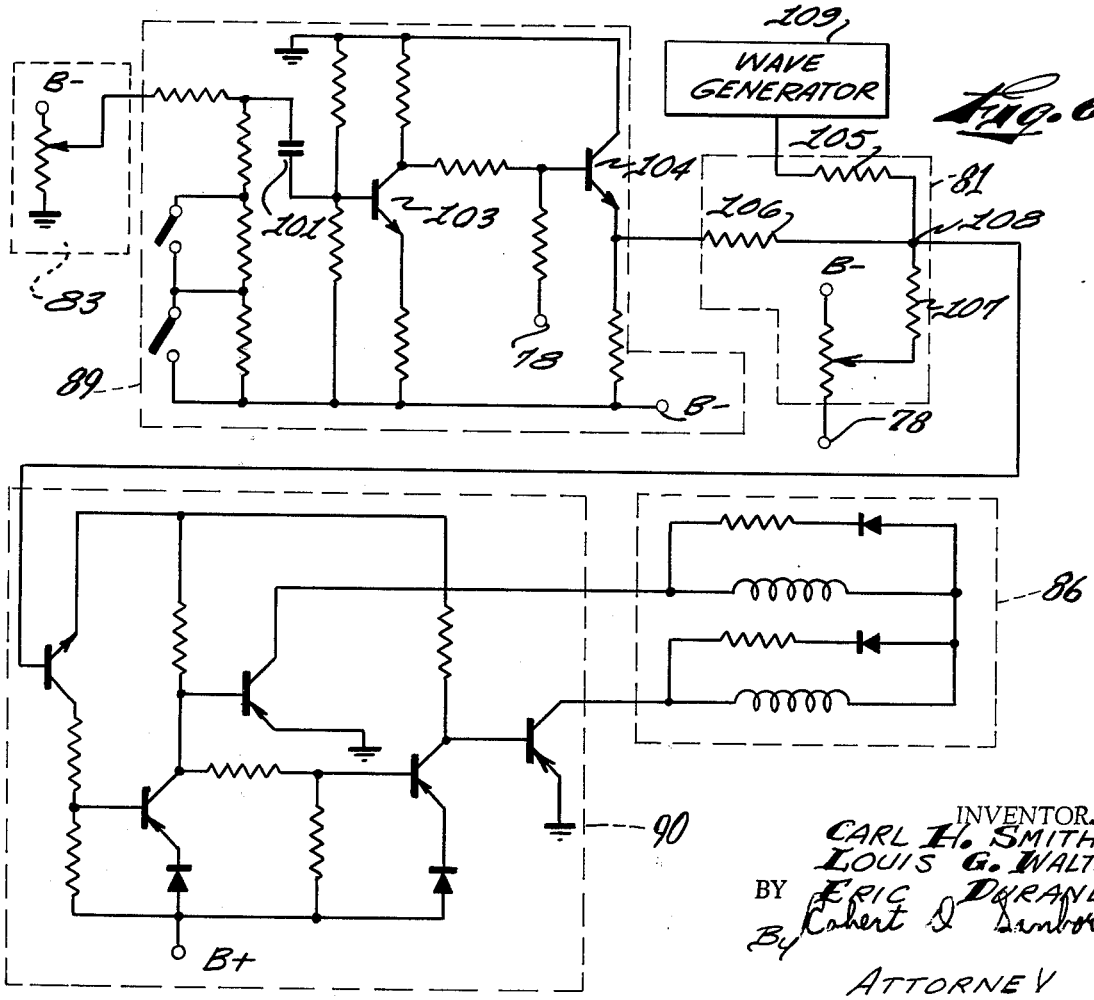

Other objects of invention will become apparent from the following description read in conjunction with the accompanying drawings, in which:

FIG. 1 is a diagrammatic view illustrating the flight of a missile from a vehicle gun to a ground target, FIG. 2 is a block diagram illustrating a principal aspect of the guidance and control system of the invention, FIG. 3 is a block diagram of the guidance and control computer of the system of FIG. 2, FIG. 4 is a diagram of the missile receiver of the system of FIG. 2, FIG. 5 is a block diagram of the flight control of the system of FIG. 2, FIG. 6 illustrates the gain equalizer amplifier and valve drive amplifier of the flight control of FIG. 5, and FIG. 6 is a schematic block diagram of the missile receiver of the system of FIG. 2.

According to a principal aspect of the invention there is provided a guidance and control system for continuously maintaining a missile along the line of sight between a ground vehicle and a ground target. A first communication link between the missile and the vehicle, including a missile source transmitting infrared energy and a vehicle tracker, continuously measures the location of the missile with respect to the line of sight, with the vehicle tracker providing yaw and pitch error signals. A guidance and control computer in the vehicle generates compensating signals proportional to missile flight time and target motion at right angles to the line of sight, and combines the compensating signals with equalized error signals to generate pitch and yaw command signals. A second communication link between the missile and the vehicle, including a vehicle transmitter for transmitting the pitch and yaw command signals and a missile receiver for receiving the command signals, provides correction signals to missile flight control means for maintaining the missile along the line of sight. The flight control means includes an equalization network for stabilizing the correction signals.

Referring now to the drawing and in particular to FIG. 1, there is illustrated a diagrammatic view of the line of flight 18 of a missile 14 between a gun barrel 17 and a target 13. In the ground vehicle the gunner visually acquires the target 13 and continuosly maintains the target line of sight 11 through an optical sight 12 on the ground vehicle. Suitable launch control means in the vehicle responsive to manual control by the gunner initially launch the missile 14 from the barrel 17. Initially, the missile 14 is launched on the line of flight 18 which corresponds to the direction in accordance with the target line of sight 11 acquired by the gunner through the sight 12. As soon as the missile leaves the gun barrel 17 a missile tracker 15 on the ground vehicle established an infrared link with a missile source located in the missile 14 and continuously determines the deviation of the line 18 of the missile course from the target line of sight 11 established by the gunner through the sight 12. Until missile 14 reaches target 13, the missile is continuously controlled by infrared command means from the ground vehicle in accordance with missile deviation determined by the tracker 15, with signals going to the missile 14 from the vehicle command means to cause appropriate actuation of the missile flight control system maintaining the missile on the line of sight 11.

Referring now to FIG. 2, there is illustrated a block diagram of the guidance and control system of the invention. In FIG. 2 the missile 14 is continuously tracked by means of an infrared command link between the missile tracker 15 on the vehicle and a missile source 21 in the missile 14. The missile tracker 15 detects infrared energy from the missile source 21 and generates pulse signals whose duration represents the amount of missile 14 deviation from the line of sight 11 in azimuth and elevation. The missile tracker system may be a pulse duration modulated system as described in copending application Ser. No. 148,092, filed Oct. 27, 1961 by J. L. Johnson and R. U. Pierotti for a RA- DIANT ENERGY TRACKING DEVICE. A pulse duration modulated system such as described in the copending application referred to above is relatively insensitive to amplitude effects such as atmospheric shimmer encountered by the missile flying close to the ground.

The output signal from the missile tracker 15 representing azimuth and elevation error of the missile 14 from the line of sight is fed to a guidance and control computer 22 which equalizes the signal and further modifies the signal in accordance with compensating signals proportional to missile flight time and target motion at right angles to the line of sight sensed by rate gyros 23. The equalized and compensated signals at the output of the guidance and control computer 22 represent control force commands in pitch and yaw required to reduce the deviation of the missile 14 from the line of sight 11. These signals are coded for transmission by a modulator transmitter 24 which produces pulse width signals in yaw and in pitch. A missile receiver 25 in the missile 14 receives the modulated signals transmitted from the vehicle and converts the combined yaw and pitch command information into signals to be utilized by the flight control 31 to provide force control to the missile 14 through control valves 26, with attitude gyros 27 providing the necessary pitch, roll, and yaw inertial reference of the missile.

Referring now to FIG. 3, there is illustrated a block diagram of the guidance and control computer 22 of the system of FIG. 2. In FIG. 3 the missile tracker 15 provides output signals proportional to the missile deviation from the line of sight in azimuth and elevation. A yaw error signal is fed from the tracker 15 to a yaw equalizer network 41 which comprises a double lead lag network of conventional type to receive yaw position error signals from the tracker 15 and to provide enough lead to compensate for the inherent phase lag in the system. The yaw equalizer network 41 also provides the necessary compensating phase lead for control system linearity and stability. Similarly, a pitch equalization network 42 responsive to pitch error signals from the missile tracker 15 provides the compensating phase lead for the pitch error signals. The use of lead-lag networks to stabilize servomechanisms is taught, for example, in the textbook *Servomechanisms and Regulating System Design*, Vol. 1, by H. Chestnut and R. W. Mayer (John Wiley & Sons, Inc., New York 1951), at pages 264 to 270 and pages 334 to 336. The specific usefulness of such networks for stabilizing control and guidance systems for guided missiles is taught, for example, in the article, "Missile Control Demands Stabilization and Guidance", by George Reehl, *Electronics Industries and Tele-Tech,* September 1957 at page 54 and following. Yaw and pitch error signals from and following. Yaw and pitch error signals from equalizer networks 41 and 42 are electrically limited by yaw limiters 43 and pitch limiters 44, respectively to insure that the magnitude of the first missile position overshoot of the line of sight is bounded to an acceptable level and that the magnitude of any missile position limit cycles that may occur during the flight due to unfavorable outer loop and inner loop gain combinations do not exceed reasonable values. The outputs of limiters 43 and 44 are fed respectively to a yaw summation circuit 45 and a pitch summation circuit 46.

a computer programmer 47 provides compensating signals based on line of sight rate information obtained from the rate gyros 23 proportional to target motion. The programmer 47 also generates a gain signal based on the changes in the dynamic characteristics of the system during the flight of the missile. The gain compensating signal is used to compensate for variation in tracker gain and to provide desired outer loop gain as the missile flys from the vehicle to the target. This gain variation, which is the same in both pitch and yaw, is provided by the computer programmer 47 which typically may mechanize the signal using electromechanically programmed variable resistors to control the scale factor of signals fed to yaw and pitch summation circuits 45 and 46. Additionally, the computer programmer 47 provides a line of sight rate force bias signal to the summation circuits 45 and 46 which is based on a programmed biased input established by the programmer 47 mechanized in accordance with the function of the line of sight angular rate. In other words, if the missile is to remain on the line of sight to the target in the presence of target motion at right angles to the line of sight, it must accelerate in the direction of target motion. To generate the necessary force commands would require the existence of a position deviation from the line of sight in the direction opposite to target motion. Since system accuracy depends on how well the guidance system can maintain the missile on the line of sight, such bias errors if uncompensated would seriously affect accuracy.

The yaw summation circuit 45 and the pitch summation circuit 46 combine the signals from the limiters 43 and 44 and the compensating signals from the computer programmer 47 to provide outputs to wave generators 48 and 49 which are yaw and pitch force commands, respectively. The necessary range gain program and equalizer changes may be accomplished by means of a range gain programmer which may consist of motor driven potentiometer and cams to actuate timing switches. This basic timing is referenced to the time of missile exit from the launch tube. The pitch and yaw channels of the guidance and control circuitry are identical with one exception. A pitch trim bias is supplied to the summation circuit 46 to compensate for the variations in the missile's characteristics as its center of gravity changes during fuel consumption and its thrust is lost at burnout. The timing for this bias is provided by a range gain programmer in the computer programmer 47.

Wave generators 48 and 49 provide signals to yaw and pitch modulators 51 and 52, respectively, which produce modulated signals in yaw and pitch. Projection optics 53 and 54 transmit modulated yaw command pitch command signals at the terminals 55.

Referring now to FIG. 4, there is illustrated a schematic block diagram of the missile receiver 25 in the missile 14. An optics sensor 61 receives combined pitch and yaw modulated command signals from the projection optics 53 and 54 of the transmitter 24 of FIG. 2 and presents the signals through a preamplifier 62 to a channel separation filter 63. The pitch and yaw signals are filtered by the separation filter 63 into two-frequency domains fed respectively to pitch and yaw channels which have identical circuitry. In the yaw channel the yaw signal is fed to a limiting amplifier 64 which includes a transistor 65 for amplifying, and a pair of input diodes 66 and 67 to provide signal limiting. The output of the limiter amplifier is directly coupled to a discriminator 68 which is a frequency discriminator detector circuit having a pair of tuned transformer circuits 69 and 70 connected in parallel. The output of the transistor of the transformer circuits 69 and 70 are diode detected by diodes 71 and 72, and connected together in DC opposition through resistors 73 and 74. The resultant output of the discriminator 66 is a frequency demodulated pulse duration modulated signal which is directly coupled into the transistors 75 and 76 which combine with the resistor capacitor circuits 77 to provide an RC active low pass filter.

The output of the pitch and yaw channels are demodulated pitch and yaw command signals at the terminals 78 and 79 which are fed into pitch and yaw summation circuits 81 and 82 as illustrated in the flight control block diagram of FIG. 5. The missile flight control is performed by equipment in the missile 14 which functions to supply electrical drive signals to pitch, yaw, and roll valves 86, 87, and 88, which affect missile control. The pitch command signal at the terminal 78 is compared to gyro feedback information received from a pitch gyro 83 which measures the missile pitch angle and supplies the information to a pitch gain equalizer amplifier 89 which provides open inner loop response characteristics to stabilize inner loop and provide optimum balance in the system response to disturbance inputs such as thrust and misalignments in gyro drift. The gain equalizer amplifier 89 may consist of a transistor voltage amplifier and an appropriate network of resistors and capacitors to provide desired amplitude and frequency characteristics. The output of the pitch gain equalizer amplifier 89 is combined in summation circuit 81 with a pitch command signal 78 to feed a signal to the valve drive amplifier 90 which is connected to provide control signals to the pitch valve 86. Similarily, in the yaw channel yaw gyro 93 is connected to a yaw gain equalizer amplifier 94 which provides a signal to a summation circuit 82 which is combined with the yaw command signal at the terminal 79 to provide a control signal to a valve drive amplifier 96 to control the yaw valve 87. The control valve 88 is controlled directly from a roll gyro 97 which feeds the signal into a roll gain equalizer amplifier 98 and a valve drive amplifier 99. The measurement of roll attitude is used as a direct position reference in that the missile roll attitude is controlled to follow the gyro rotor roll attitude.

Referring now to FIG. 6, there is illustrated a circuit diagram of the pitch gain equalizer amplifier 89 and valve drive amplifier 90 of the flight control diagram of FIG. 5. In FIG. 6 the pitch gyro 83 provides an output signal which is coupled through a capacitor 101 to the input of the transistor 103 which operates to amplify the signal. The resistor circuitry, which may be varied in gain by corresponding switches combines with the capacitor 101 to provide a gain equalizer amplifier circuit. The output of the transistor 103 is coupled to the input of transistor 104 whose output is fed into a summation circuit 81 which is shown as three resistors 105, 106, and 107 connected to provide a summing signal at the terminal 108. Resistor 105 receives a signal from a wave generator 109 which may, for example, be a saw tooth wave generator. Resistor 107 is connected to receive a pitch command signal from terminal 78 of the diagram of FIG. 5. The output terminal 108 feeds the signal to a valve drive amplifier 90 whose output is connected to pitch valve 86. When there is no pitch error, the sum of the signals supplied to junction 108 by sawtooth wave generator 109, pitch gyro 83 and pitch command terminals 78 (see FIG. 4) is such as to cause the two solenoids of pitch valve 86 to be energized sequentially for equal time periods. Under such conditions the pitch valve produces no change in the pitch of missile 14. However, when a pitch error occurs, the sum of the signals supplied by generator 109, pitch gyro 83 and pitch command terminals 78 changes in such manner as to cause the two solenoids of valve 86 to be energized sequentially for unequal time periods the respective durations of which are such as to cause reduction of the pitch error.

The guidance and control system illustrated in the present invention guides a missile from a ground vehicle to a ground target with extreme accuracy and reliability. Equalizer and other compensating networks in the guidance and control loops particularly serve to provide an accurate and stable system.

Although the invention has been described and illustrated in detail, it is to be clearly understood that the same is by way of illustration and example only and is not taken by way of limitation, the spirit and scope of this invention being limited only by the terms of the appended claims.

We claim:

1. A missile guidance system for continuously guiding a missile along a line of sight between a vehicle and a target comprising, tracker means which is located solely on said vehicle, includes a radiation-sensitive element, and is responsive to the impingement of radiant energy on said element to generate signals indicative of the direction of impingement of said radiant energy on said element, relative to the orientation of said element, a source of radiant energy, positioned on said missile, means, located solely on said vehicle and operable by a human operator, for locating said element of said tracker means in an orientation and position which bears a fixed spatial relationship to said line of sight, said tracker means, when said element is so oriented and positioned and impinged by radiant energy from said source, being adapted to generate yaw signals indicative of the deviation in azimuth of said source with respect to said line of sight and being also adapted to generate pitch signals indicative of the deviation in elevation of said source with respect to said line of sight, said source and said tracker means comprising a first communications link between said missile and said vehicle, a guidance and control computer in said vehicle having a yaw channel responsive to said vehicle tracker yaw signals and having a pitch channel responsive to said vehicle tracker pitch signals, each of said yaw and pitch channels having an equalizer network responsive to the respective yaw and pitch signals from said vehicle tracker to equalize said yaw and pitch signals, each of said yaw and pitch channels having means for limiting said equalized signal in each said channel, a computer programmer for generating a gain compensating signal proportional to the missile flight time, and a line of sight compensating signal proportional to target motion at right angles, each of said yaw and pitch channels having a summation circuit for adding said limited equalized signals, said gain compensating signal, and said line of sight compensating signal to provide yaw and pitch command signals, a second communication link between said missile and said vehicle including a transmitter in said vehicle for transmitting said yaw and pitch command signals, and a receiver in said missile for receiving said command signals, and flight control means in said missile for guiding said missile in response to said command signals received by said receiver.

2. The missile guidance system recited in claim 1 wherein said first and second communication links are infrared links.

3. A missile guidance system according to claim 1, wherein said means for locating said element comprises optical means for sighting said target.

4. In a system for guiding a missile from a ground vehicle to a ground target along a line of sight, a source of infrared radiation, located in said missile, tracker means which is located solely on said vehicle, includes an element sensitive to infrared radiation and, is responsive to the impingement of infrared radiation on said element to generate signals indicative of the direction of impingement of infrared radiation on said element, relative to the orientation of said element, means located solely on said vehicle and operable by a human operator, for locating said element of said tracker means in an orientation and position which bears a fixed spatial relationship to said line of sight, said tracker means, when said element is so oriented and positioned and impinged by infrared radiation from said source, being adapted to generate continuously signals indicative of the location of said missile with respect to said line of sight, said source and said tracker means comprising a first infrared link between said missile and said vehicle, computer means, located in said vehicle, comprising a computer programmer for generating compensating signals proportional to missile flight time and target motion at right angles to said line of sight and also comprising means for combining said compensating signals and said signals generated by said first infrared link to generate pitch and yaw command signals proportional to the location of said missile with respect to said line of sight, a second infrared link between said vehicle and said missile for combining said pitch and yaw command signals and transmitting said combined signals to said missile, said second infrared link including a modulator in said vehicle and a receiver in said missile responsive to said transitted combined signals, said receiver including a channel separation filter responsive to said combined signals for separating said signals into first and second signal components, said first signal component having frequencies which lie within a first frequency domain and vary according to said pitch command signal, and said second signal component having frequencies which lie within a second frequency domain and vary according to said yaw command signal, a pitch channel selectively responsive to said first signal component and a yaw channel responsive to said second signal component, each of said channels having means for limiting said signal component to which said channel is responsive, each of said channels having a circuit means including a discriminator responsive to said limited signal component in said channel for producing a frequency-demodulated signal, said frequency-demodulated signal in said pitch channel being indicative of said pitch command signal and said frequency-demodulated signal in said yaw channel being indicative of said yaw command signal, and means in said missile, responsive to said frequency-demodulated signals, for controlling the flight of said missile.

5. The system of claim 4 wherein said flight control means includes gyro means for generating a signal indicative of the missile pitch angle, a first gain equalizer amplifier for equalizing said missile pitch angle signal, a first summation circuit for summing said frequency demodulated pitch command signal and said equalized missile pitch angle signal, gyro means for generating a signal indicative of the missile yaw angle, a second gain equalizer amplifier for equalizing said missile yaw angle signal, a second summation circuit for summing said frequency-demodulated yaw command signal and said missile yaw angle signal, said missile having pitch and yaw control valves respectively responsive to the outputs of said first and second summation circuits.

6. A missile guidance system according to claim 4, wherein said means for locating said element comprises optical means for sighting said target.

* * * * *